US008624739B2

(12) United States Patent
Forster

(10) Patent No.: US 8,624,739 B2
(45) Date of Patent: Jan. 7, 2014

(54) ELECTRONIC ARTICLE SURVEILLANCE SYSTEM INCLUDING LOW-COST EAS TAG

(75) Inventor: Ian J. Forster, Essex (GB)

(73) Assignee: Avery Dennison Corporation, Pasadena, CA (US)

( * ) Notice: Subject to any disclaimer, the term of this patent is extended or adjusted under 35 U.S.C. 154(b) by 300 days.

(21) Appl. No.: 13/048,984

(22) Filed: Mar. 16, 2011

(65) Prior Publication Data

US 2012/0235818 A1 Sep. 20, 2012

(51) Int. Cl.
*G08B 13/14* (2006.01)

(52) U.S. Cl.
USPC ..... 340/572.1; 340/568.1; 340/572.8; 340/572.9

(58) Field of Classification Search
USPC ..... 340/572.1, 568.1, 568.4, 571, 572.3, 340/572.8, 572.9
See application file for complete search history.

(56) References Cited

U.S. PATENT DOCUMENTS 4,993,245 A * 2/1991 Ott ..... 70/57.1
5,031,756 A * 7/1991 Buzzard et al. ..... 206/308.2
6,806,620 B1 10/2004 Wischnewskiy
7,053,525 B2 5/2006 Funakubo et al.
7,215,250 B2 * 5/2007 Hansen et al. ..... 340/572.9
2004/0100385 A1 5/2004 Hansen et al.
2010/0097223 A1 * 4/2010 Kruest et al. ..... 340/572.1

FOREIGN PATENT DOCUMENTS

EP 0545494 6/1993

OTHER PUBLICATIONS

International Search Report dated Jun. 5, 2012 for International Application No. PCT/US2012/028395 filed Mar. 9, 2012.
Written Opinion dated Jun. 5, 2012 for International Application No. PCT/US2012/028395 filed Mar. 9, 2012.

* cited by examiner

*Primary Examiner* — Toan N Pham
(74) *Attorney, Agent, or Firm* — Avery Dennison Corporation

(57) ABSTRACT

A robust tag. The robust tag may include a body section, at least one movable latching member disposed within the body section, at least one attachment structure receivable within the body and selectively engageable to the at least one latching member; and at least one responsive member disposed within the body and in cooperative arrangement with the at least one latching member. Upon the application of a signal to at least one drive position on the body section, the responsive member generates a flexural wave that induces a movement of the at least one latching member, so as to disengage the at least one latching member from the at least one attachment structure.

14 Claims, 2 Drawing Sheets

ELECTRONIC ARTICLE SURVEILLANCE SYSTEM INCLUDING LOW-COST EAS TAG

BACKGROUND OF THE INVENTION

Radio frequency devices, such as resonant absorbers, acousto-magnetic structures and radio frequency identification (RFID) tags, can be encapsulated in mechanically robust materials, such as laminations of plastic or injection molded thermoplastic cases to protect them from either intentional or unintentional damage. One application of such devices is in electronic article surveillance (EAS) tags, which are commonly used in various locations to prevent unauthorized removal of inventory from a controlled area. Such tags may be paired with a detection system that is located at a boundary of the controlled area, and which generates an alert when an EAS tag is detected proximate to the detection system. For example, in retail establishments, EAS tags are affixed to articles for sale within the establishment and detection systems are installed at points of exit from the establishment. Thus, attempts at inventory theft are detected and successful attempts are markedly reduced.

Alternatively the movement of the devices may be tracked at locations inside a controlled area, such as a changing room in a apparel retail establishment, to detect unusual events that may be associated with theft occurring. To remove an article from a controlled area, the tag must be decoupled from the article. As tags are intended to only be decoupled from articles by personnel authorized to do so, special tools or detachment devices are typically provided so as to decouple the tag without damaging the article. Many such tools and detachment devices utilize solely mechanical means to detach the tag. However, such tags are susceptible to detachment by unauthorized individuals who can employ an approximation of the detachment mechanism to defeat the tag. Other types of EAS tags may utilize more sophisticated methods for detachment, for example non-mechanical or non-contact methods. However, such tags result in increased costs of manufacture and increased costs of utilization. Thus, a low-cost electronic article surveillance tag that is not easily defeatable by unauthorized methods is needed.

SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

According to at least one exemplary embodiment, a low cost latch mechanism designed to integrate with a robust tag is disclosed. The robust tag can have at least one latch mechanism in selective engagement to at least one attachment structure, the at least one latch mechanism being in cooperative arrangement with at least one member responsive to acoustic energy such that a flexural wave generated by the at least one acoustically responsive member induces a movement of the at least one latch mechanism. A tag detaching device adapted to receive the robust tag in proximity and having a signal generator for emitting a signal at one or more frequencies to which the at least one acoustic member is responsive is also disclosed. The signal generator can emit an acoustic signal at ultrasonic frequencies, and the at least one acoustic member can be responsive to the acoustic signal such that application of the acoustic signal to the at least one acoustic member generates a flexural wave which induces movement of the at least one acoustic member so as to disengage the at least one latching mechanism from the at least one attachment structure. Said signal generator may be a specific device manufactured for the task of removing robust tags, or may another device capable of emitting acoustic energy, such as a computer, netbook or phone, said device receiving the required frequencies or tone pattern in response to an identification code or pattern associated with the product. The identification code may be either entered manually, or read from an RFID device embedded in the robust tag. Obtaining the required unlocking pattern may involve interaction of the identification code with a remote system via the web or other data connection.

According to another exemplary embodiment, a robust tag is disclosed. The robust tag may include a body section, at least one movable latching member disposed within the body section, at least one attachment structure receivable within the body and selectively engageable to the at least one latching member; and at least one responsive member disposed within the body and in cooperative arrangement with the at least one latching member. Upon the application of a signal to at least one drive position on the body section, the responsive member generates a flexural wave that induces a movement of the at least one latching member, so as to disengage the at least one latching member from the at least one attachment structure.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

DETAILED DESCRIPTION OF THE INVENTION

Figure 1A:
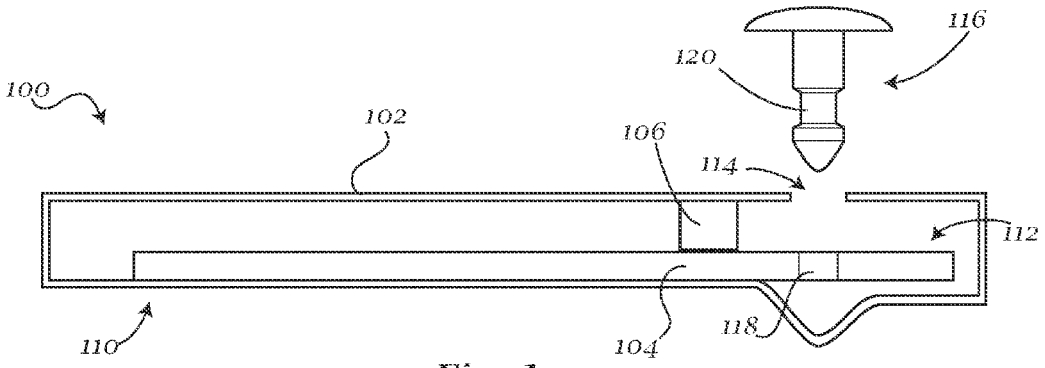
FIG. 1*a* is a side cutaway view of an exemplary embodiment of a robust tag.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a locking mechanism for a robust tag including at least one acoustic member is disclosed. The tag may include a housing, at least one latch mechanism, at least one attachment structure, at least one acoustic member, and at least one radio frequency device. The housing may be formed from a plastic material, and may be made by any desired method, for example, by injection molding. Disposed within the housing may be at least one latch mechanism, at least one pin or other attachment structure intended to go through or around an item, at least one acoustic member, and, if desired, at least one radio frequency device. The radio frequency device may perform Electronic Article Surveillance (EAS) functions in conjunction with a suitable detection apparatus located at one or more locations in a store.

The at least one latch mechanism can be configured to engage with the at least one attachment structure so as to facilitate attachment of the tag to a desired article. The latch mechanism may include a user-operable portion, for example, a tab, a handle, a dial, or any other structure that may be manually operated by the user, and an engagement portion that is configured to engage with a attachment structure. The latch mechanism may have a translational configuration, wherein the engagement portion is moved linearly so as to engage with the attachment structure, or a rotational configuration, wherein a rotational movement of the engagement portion results in engagement with the attachment structure. Alternatively, at least one latch mechanism may be disposed entirely within the tag, and the user-operable portion may be provided on the attachment structure. For example, the attachment structure may be a pin having a head and a stem, the head facilitating insertion, by the user, of the pin into the tag, such that the stem of the pin may engage with latch mechanism.

In the disengaged state, the user-operable portion of the at least one latch mechanism can protrude from the housing, be accessible via an aperture in the housing, or be otherwise disposed such that a user can manually operate the at least one latch mechanism or the attachment structure so as to engage the engagement portion of the latch mechanism with the attachment structure while affixing the robust tag to the desired article. Engaging the latch mechanism with the attachment structure may require a translational movement of the latch mechanism towards the attachment structure, for example, pushing the latch mechanism into the housing until the engagement portion engages with the attachment structure, or for example, pushing the attachment structure into the housing until it engages with the engagement portion of the latch mechanism. Alternatively, engaging the latch mechanism with the attachment structure may require a rotational movement of the latch mechanism, for example, rotating a dial so as to engage the engagement portion of the latch mechanism with the attachment structure.

The latch mechanism may be disposed fully within the housing, or may otherwise be rendered inaccessible from the exterior of the housing. Alternatively, a rotary latch mechanism may have a one-way rotary or one way linear configuration, so as to allow engaging, but not disengaging the latch mechanism. Thus, the latch mechanism, when in the engaged configuration, may not be manually disengaged from the attachment structure, or otherwise defeated, which in turn can decrease the likelihood of the robust tag being detached from the article to which it is affixed.

Figure 1B:
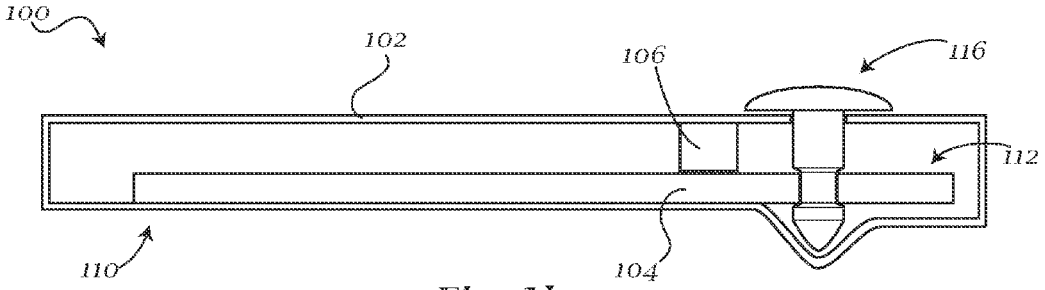
FIG. 1*b* is a side cutaway view of an exemplary embodiment of a robust tag engaged with an attachment structure that is received therein.
Figure 1C:
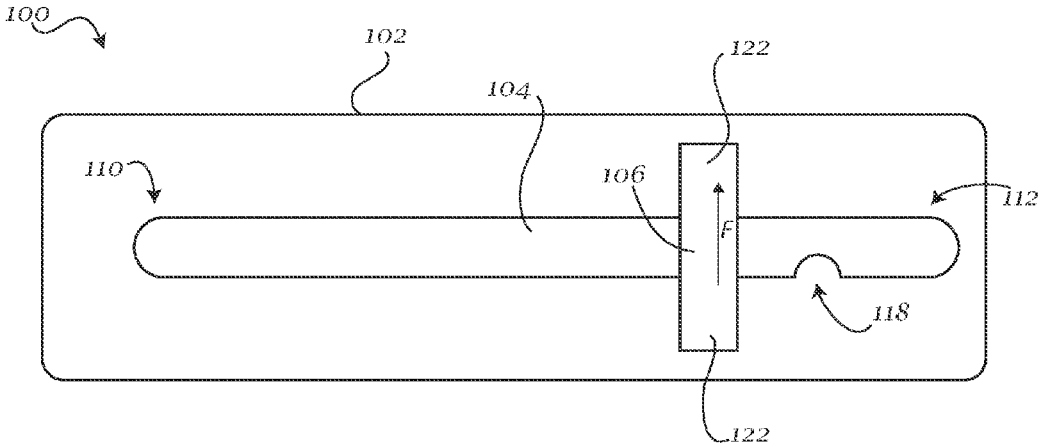
FIG. 1*c* is a plan cutaway view of an exemplary embodiment of a robust tag.

Turning to FIGS. 1*a-c*, one embodiment of a robust tag 100 is shown. Robust tag 100 can include a body section 102 incorporating a latch beam 104, and an acoustically responsive member 106 that, when driven at two drive positions with a suitable signal, can generate a flexural wave that applies force to beam 104. Beam 104 may be secured to body 102 at a first end 110, such that a second end 112 of beam 104 may be capable of lateral or arcuate movement. First end 110 may be disposed remote from an entry point 114, while second end 112 may be disposed proximate to the entry point 114. An attachment structure 116, or a portion thereof, may be inserted through entry point 114 so as to engage with second end 112 of beam 104. Second end 112 may include a notch 118, or any other engagement structure, that can facilitate engagement between attachment structure 116 and beam 104.

In one embodiment, attachment structure 116 may be a pin that has an area of reduced diameter 120 at a point along its length, as shown in FIG. 1*a*. Attachment structure 116 may be made of metal or any other suitable material, and may be inserted through a garment or other article so as to couple the pin to the article. Subsequently, the pin may be inserted into robust tag 100. As the pin is inserted into robust tag 100, latch beam 104 may be moved out of its resting position. When a sufficient length of the pin is inserted such that reduced diameter section of the pin is reached, the latch may return to the resting position, with reduced diameter section 120 being disposed within notch 118 of beam 104, as shown in FIG. 1*b*. Thus, the pin cannot be removed without the second end 112 of latch beam 104 being bent away from attachment structure 116; as latch beam is 104 is inaccessible to the user due to body 102 being sealed, beam 104 may be bent away from attachment structure 116 by way of a flexural wave generated in the structure, which may apply force F to beam 104. To that end, a pair of acoustic or mechanical vibration signals may need to be applied in the correct phase, frequency and amplitude at two drive positions 122 along acoustically responsive member 106. Force F may move beam 104 out of the resting position, thereby allowing attachment structure 116 to be withdrawn from body 102 of tag 100.

Figure 1D:
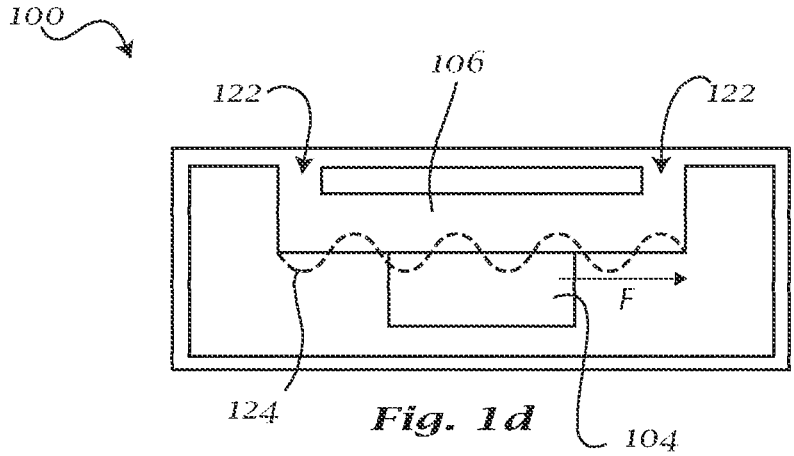
FIG. 1*d* is a front cutaway view of an exemplary embodiment of a robust tag.

FIG. 1*d* shows further details of the interaction between acoustically responsive member 106 and latch beam 104. Acoustic or mechanical vibration signals applied in the correct phase, frequency, and amplitude to drive positions 122 may generate a flexural wave 124 in the structure of robust tag 100. Flexural wave 124 may apply force F to beam 104, thereby moving beam 104 out of the resting position, thereby allowing attachment structure 116 to be withdrawn from body 102 of tag 100.

Figure 1E:
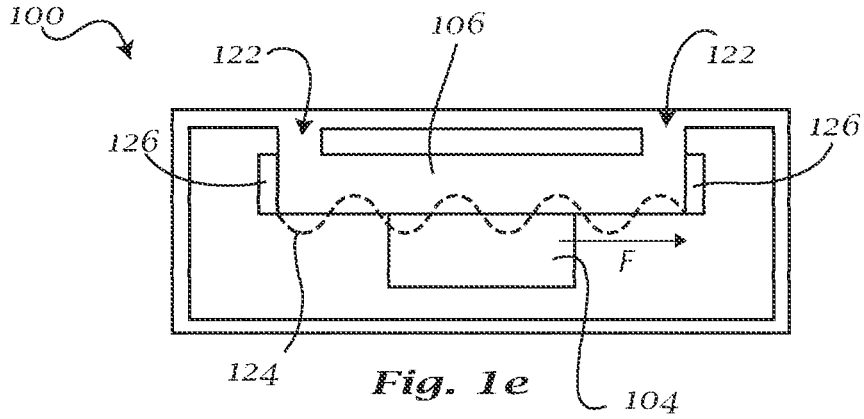
FIG. 1*e* is a front cutaway view of another exemplary embodiment of a robust tag.

FIG. 1*e* shows an additional exemplary embodiment of tag 100. The embodiment may include a pair of metallic elements 126 mounted proximate to drive positions 122. The metallic elements may be formed from any ferromagnetic metal, for example, sections of steel foil. Metallic elements 126 may facilitate converting an oscillating magnetic field into local acoustic drive energy for the acoustically responsive member 106.

Figure 2:
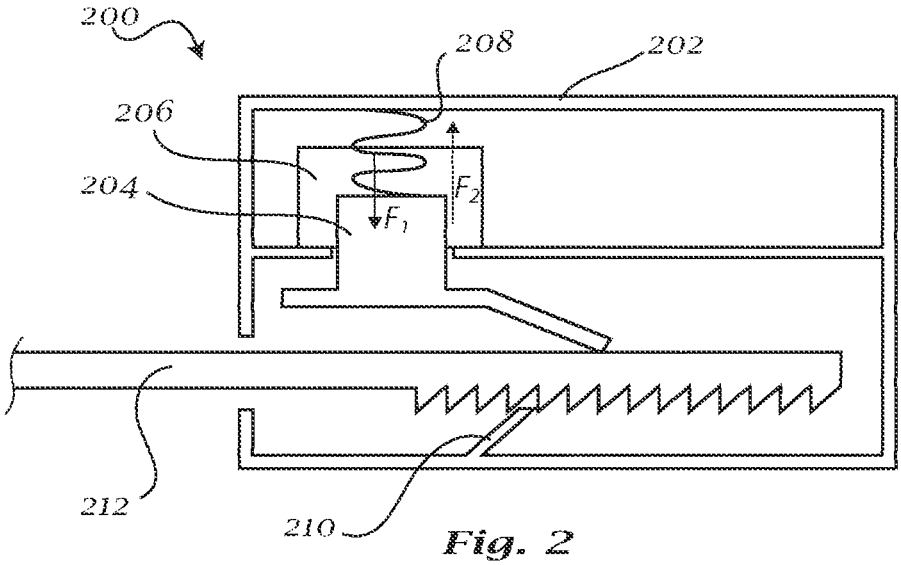
FIG. 2 is a side cutaway view of another exemplary embodiment of a robust tag.

Turning to FIG. 2, another exemplary embodiment of a robust tag 200 is shown. Robust tag 200 may include a body section 202, a compression element 204 coupled to a spring 208, an acoustically responsive member 206, and a pawl 210. A ratchet 212 may be coupled to a garment or other article, and inserted through an entry point 214 on body 202. As ratchet 212 is inserted, spring 208 and compression element 204 exert a force $F_1$ on ratchet 212 so as to bring the teeth of ratchet 212 into engagement with pawl 210, thereby preventing ratchet 212 to be withdrawn from body 202 of robust tag 200. In order to withdraw ratchet 212, a flexural wave generated in the structure may apply force $F_2$ to compression element 204, such that $F_2>F_1$, so as to compress spring 208 and allow the teeth of ratchet 212 to be disengaged from pawl 210. To generate the flexural wave, acoustic or mechanical vibration signals may need to be applied in the correct phase, frequency and amplitude to drive positions along acoustically responsive member 206.

The at least one acoustically responsive member may be disposed within the housing such that it abuts, is coupled to, or is otherwise in cooperative arrangement with the at least one latch mechanism. Additionally, the at least one acoustically responsive member may be configured to be responsive to acoustic energy applied to the acoustically responsive member at a desired frequency or frequencies. In some embodiments, the acoustic energy may be applied at ultrasonic frequencies, that is, at frequencies over 20 kHz. Furthermore, the acoustically responsive member may be configured such that it is responsive to a narrow frequency range. The particular frequency range that the acoustic member is responsive to may be adjusted as desired, for example, during manufacture of the robust tag. In other embodiments, the acoustically responsive member may be configured to respond to electromagnetic energy applied to the acoustically responsive member at desired frequencies.

In order to detach the robust tag, for example tag 100 or tag 200, from the article that the tag is affixed to, the latch mechanism may be disengaged from the attachment structure of the tag. As the latch mechanism is configured to not be manually disengageable from the attachment structure, the disengagement of the latch mechanism and the attachment structure may be accomplished by use of the tag detaching device.

The tag detaching device may include a casing, a portion to hold the tag in a relatively fixed position, and a signal generator. The robust tag holding portion may be formed as desired, for example as part of the casing, and may provide a recessed, contoured or otherwise formed surface that facilitates desired placement of the robust tag within the receiving portion. The signal generator may be configured to generate a desired signal, comprising one or more elements at defined frequency, amplitude and phase. Said signal, when coupled from the tag receiving portion into the robust tag, and hence to one or more acoustic member, may generate a flexural traveling wave 124, which applies a linear or rotational force to the latching mechanism, for example latch beam 104 or compression element 204. In some embodiments, the signal generator may be configured to generate an acoustic signal at ultrasonic frequencies. For example, the signal generator may include an oscillator and at least one ultrasonic driver, wherein the at least one ultrasonic driver may employ piezoelectric elements to generate, via coupling between the tag receiving portion and the robust tag structure including the at least one acoustically responsive member, an ultrasonic flexural traveling wave. In other embodiments, the signal generator may generate electrical or magnetic signals, which interact with a material proximate to at least one acoustically responsive member, so as to generate the acoustic signal at the desired frequencies to generate the flexural wave.

To disengage the latch mechanism, for example latch beam 104 or compression element 204, from the attachment device, for example pin 116 or ratchet 212, the robust tag 100/200 may be placed into the receiving portion of the tag detaching device. Subsequently, the tag detaching device may be activated, whereupon the signal generator may generate an acoustic signal, at one or more locations, for example drive positions 122, at the particular frequency, phase and amplitude, or a plurality of same, to which the acoustically responsive member 106/206 of the tag 100/200 is responsive. If the characteristics and location of the acoustic signal matches those needed, the acoustically responsive member may be driven by the acoustic energy, essentially forming an ultrasonic motor. The acoustically responsive member can thus generate a flexural wave which can apply a linear or rotational force to another member, for example a latching mechanism such as latch beam 104 or compression element 204. As the acoustic member is in cooperative arrangement with the latch mechanism, the translational or rotational force generated by the flexural wave generated by the acoustically responsive member can result in the movement of the latch mechanism. Accordingly, the latch mechanism may be positioned such that the first position of the latch mechanism corresponds to the latch mechanism being engaged with the attachment structure, while the second position of the latch mechanism corresponds to the latch mechanism being disengaged from the attachment structure. As the latching mechanism is moved from the first position to the second position, the latching mechanism may be disengaged from the attachment structure, thereby allowing the robust tag to be detached from the article to which it is affixed.

As an added security measure, to generate the flexural wave by the acoustically responsive member 106/206, the signal generated by the detaching device may need to be applied to at least one specific point on the robust tag. Furthermore, embodiments of the robust tag may include varying configurations of robust tags, which may in turn include, if desired, a plurality of latch mechanisms, a plurality of pins, and a plurality of acoustically responsive members. Thus, in such embodiments, to generate the flexural wave by acoustically responsive member 106/206, the signal generated by the detaching device may need be applied to a plurality of specific points on the robust tag or the acoustically responsive member, thereby decreasing the likelihood of the latch mechanism being disengaged by unauthorized means.

The likelihood of unauthorized disengagement of the latch mechanism can also be decreased due to the frequency of the acoustic signal needing to match the frequency to which the acoustically responsive member is responsive in order to drive the acoustically responsive member. The responsive frequencies for the acoustically responsive member may be adjusted as desired, for example during manufacture of the robust tag, while the frequency of the signal emitted by the signal generator may also be adjusted as desired so as to match the frequency to which the acoustic member is responsive. For example, a particular retail location may have detachment devices that operate at a particular frequency, and therefore robust tags having acoustically responsive members that match the particular frequency may be distributed to that particular location. In other embodiments, the frequency of the signal emitted by the signal generator may be adapted to automatically match the frequency to which the acoustic member is responsive. For example, a robust tag may include therein an RFID device which includes information regarding the frequency, phase, amplitude and locations to which the one or more acoustically responsive members of that robust tag are responsive, while the detaching device may include an RFID interrogator. Thus, when a particular tag is placed in the detaching device, the detaching device may interrogate the RFID tag within the robust tag and accordingly adjust the frequency of the emitted signal to match the signal characteristics and locations to which the acoustic member of the robust tag is responsive.

Thus, there is described herein an electronic article surveillance system that provides a low-cost robust tag that is difficult to defeat by unauthorized methods.

In an alternative embodiment, the product may be detached using an acoustic signal generated by a device such as a computer, mobile phone, tablet computer or other item which combines processing capability and the ability to generate an acoustic signal. The required signal characteristics may be obtained by the user either entering a code on the item, scanning an optical code such as a liner or 2D barcode, or reading an RFID device embedded into the robust tag, said code then being passed to a remote computer system to obtain an unlocking signal characteristic.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An electronic article surveillance system, comprising:

a robust tag having at least one latching mechanism in selective engagement to at least one attachment structure, the at least one latching mechanism being in cooperative arrangement with at least one acoustically responsive member such that a flexural wave generated by the acoustically responsive member induces a movement of the at least one latching mechanism;

a tag detaching device adapted to receive the electronic article surveillance tag and having a signal generator for emitting an acoustic signal at ultrasonic frequencies to which the at least one responsive member is responsive, such that application of the acoustic signal to the at least one responsive member generates a flexural wave which induces movement of the at least one latch mechanism so as to disengage the at least one latching mechanism from the at least one attachment structure; and wherein the acoustic signal is applied to a plurality of specific points on the at least one responsive member.

2. The electronic article surveillance system of claim 1, wherein the at least one responsive member is responsive to a narrow frequency range.

3. The electronic article surveillance system of claim 1 wherein the movement of the at least one latching mechanism is translational.

4. The electronic article surveillance system of claim 1 wherein the movement of the at least one latching mechanism is rotational.

5. An electronic article surveillance system, comprising:

an electronic article surveillance tag having at least one responsive member disposed therein; and a tag detaching device adapted to receive the electronic article surveillance tag and having at least one ultrasonic driver disposed therein;

wherein, when the electronic article tag is received by the tag detaching device, the at least one ultrasonic driver couples to the at least one resonant member so as to form at least one ultrasonic motor; and wherein the at least one responsive member is in cooperative arrangement with at least one latching mechanism, the at least one latching mechanism being in selective engagement with at least one attachment structure, such that a flexural wave generated by the at least one responsive member induces a movement of the at least one latching mechanism, so as to disengage the at least one latching mechanism from the at least one attachment structure.

6. The electronic article surveillance system of claim 5, wherein the at least one ultrasonic motor is a linear motor.

7. The electronic article surveillance system of claim 5, wherein the at least one ultrasonic motor is a rotary motor.

8. The electronic article surveillance system of claim 5, wherein the tag detaching device is a computer.

9. The electronic article surveillance system of claim 5, wherein the tag detaching device is a portable communications device.

10. A robust tag, comprising:

a body section;

at least one movable latching member disposed within the body section;

at least one attachment structure receivable within the body and selectively engageable to the at least one latching member;

at least one responsive member disposed within the body and in cooperative arrangement with the at least one latching member, wherein, upon the application of an acoustic signal to at least one drive position on the body section, the responsive member generates a flexural wave that induces a movement of the at least one latching member, so as to disengage the at least one latching member from the at least one attachment structure; and wherein the acoustic signal is applied to a plurality of specific points on the at least one responsive member.

11. The robust tag of claim 10, further comprising at least one metallic member disposed adjacent to the at least one drive position.

12. The robust tag of claim 10, wherein the signal has a particular phase, frequency and amplitude, and the responsive member is responsive to the particular phase, frequency and amplitude.

13. The robust tag of claim 10, wherein the attachment structure is a pin.

14. The robust tag of claim 10, wherein the attachment structure is a ratchet.

* * * * *